US005296102A

United States Patent [19]

Nicklin

[11] Patent Number: 5,296,102

[45] Date of Patent: Mar. 22, 1994

[54] DUAL CHAMBER APPARATUS FOR RECOVERY OF OIL FROM SOLID HYDROCARBONACEUS MATERIAL

[75] Inventor: Donald J. Nicklin, Corinda, Australia

[73] Assignee: Southern Pacific Petroleum NL and Central Pacific Minerals NL, Sydney, Australia

[21] Appl. No.: 737,595

[22] Filed: Jul. 25, 1991

Related U.S. Application Data

[63] Continuation of Ser. No. 574,385, Aug. 27, 1990, abandoned, which is a continuation of Ser. No. 406,812, Sep. 13, 1989, abandoned, which is a continuation of Ser. No. 273,741, Nov. 15, 1988, abandoned, which is a continuation of Ser. No. 143,241, Jan. 4, 1988, abandoned, which is a continuation of Ser. No. 826,114, Feb. 5, 1986, abandoned, which is a continuation-in-part of Ser. No. 572,859, Jan. 23, 1984, abandoned.

[30] Foreign Application Priority Data

Jan. 28, 1983 [AU] Australia ..... PF7815

[51] Int. Cl.[5] ..... C10B 1/02

[52] U.S. Cl. ..... 202/85; 202/99; 202/215; 202/223; 201/28; 201/31

[58] Field of Search ..... 202/84, 85, 99, 108, 202/109, 115, 116, 208, 215, 226, 223; 201/12, 31, 44, 28; 422/140, 142; 432/15, 58; 110/245, 263, 347; 122/4 D; 208/409–411, 427

[56] References Cited

U.S. PATENT DOCUMENTS

| | | | |
|---|---|---|---|
| 139,664 | 6/1873 | Eames et al. | 202/108 |
| 2,582,712 | 1/1952 | Howard . | |
| 2,626,234 | 1/1953 | Ban et al. | 201/31 |
| 2,819,890 | 1/1958 | Rosa et al. | 432/58 |
| 4,274,941 | 6/1981 | Janssen et al. | 201/12 |
| 4,338,283 | 7/1982 | Sakamoto et al. | 432/58 |
| 4,425,303 | 1/1984 | Schilling et al. | 422/142 |
| 4,447,297 | 5/1984 | Shang et al. | 202/99 |
| 4,457,896 | 7/1984 | Kono | 422/142 |

FOREIGN PATENT DOCUMENTS

| | | | |
|---|---|---|---|
| 15-10230 | 5/1940 | Japan | 432/58 |
| 52-46683 | 4/1977 | Japan | 432/58 |
| 5024515 | 2/1980 | Japan | 422/142 |
| 55-165416 | 12/1980 | Japan | 110/245 |
| 56-30523 | 3/1981 | Japan | 110/245 |
| 709938 | 1/1980 | U.S.S.R. | 432/58 |
| 870861 | 10/1981 | U.S.S.R. | 110/245 |

*Primary Examiner*—Joye L. Woodard
*Attorney, Agent, or Firm*—Ladas & Parry

[57] ABSTRACT

A method of and apparatus for recovering oil from solid hydrocarbonaceous material, such as oil shale, in particulate form using a combustion chamber and a reaction chamber arranged side-by-side and connected by a first passageway extending between the upper regions of the chambers and a return passageway. The particulate material is fluidized in the chambers and induced to circulate therebetween by the configuration of the chambers and passageways and/or the nature of the fluidization. Residual carbon on the spent hydrocarbonaceous material introduced into the combustion chamber through the return passageway is burnt, heating the material which then circulates through the first passageway to mix with and heat fresh feed material introduced into the reaction chamber giving off effluent vapours which are collected and processed.

1 Claim, 4 Drawing Sheets

DUAL CHAMBER APPARATUS FOR RECOVERY OF OIL FROM SOLID HYDROCARBONACEUS MATERIAL

This is a continuation of copending application(s) Ser. No. 07/574,385 filed on Aug. 27, 1990 (now abandoned) which is continuation of application Ser. No.: 07/406,812 filed Aug. 13, 1989 (now abandoned) which is a continuation application of Ser. No.: 07/273,741 filed Nov. 15, 1988 (now abandoned) which is a continuation application of Ser. No.: 07/143,241 filed Jan. 4, 1988 (now abandoned) which is a continuation application of Ser. No.: 06/826,114 filed Feb. 5, 1986 (now abandoned) which is a continuation-in-part application of Ser. No.: 06/572,859 filed Jan. 23, 1984 (now abandoned).

FIELD OF THE INVENTION

This invention relates to a method of and apparatus for use in recovering oil from solid hydrocarbonaceous material. The invention has particular application in the recovery of shale oil from oil shale, and the invention is hereinafter described in such context, but it will be understood that the invention also has application in the recovery of oil from other solid hydrocarbonaceous materials such as coal and tar sands.

BACKGROUND OF THE INVENTION

Various techniques have been developed for the recovery of oil from oil shale and, expressed simplistically, the basic requirement is that the shale be heated to a level (in the order of 550° C.) at which the shale releases its gaseous and liquid products. Designing a retort to meet this fundamental requirement as such does not present a significant problem but, in order that a shale oil recovery process might be worked in a manner which compares favourably in economic terms with the more conventional oil producing processes, the retort must be capable of providing a high throughput. This, in turn, requires a substantial heat input and the viability of shale oil production is dependent largely on achieving efficient utilization of energy input.

One approach which has been proposed for the heating of feed shale involves crushing of the shale to particulate size and contacting it in a fluidized reaction bed with spent shale which has been heated to an appropriate level, using a convenient fuel such as the residual carbon in the shale. The kerogen content of the feed shale is converted to gas and oil vapour products in the fluidized bed as a result of heat exchange between the feed shale and the heated (heat medium) shale.

SUMMARY OF THE INVENTION

The present invention is directed to a novel apparatus for recirculating heat medium shale and, in the process, of contacting the heat medium shale with fresh feed shale. However, as above mentioned, the invention has application beyond the recovery of oil from oil shale and it is applicable to the recovery of oil from other hydrocarbonaceous materials.

Thus, the present invention provides apparatus for the recovery of oil from solid hydrocarbonaceous material in particulate form comprising:

(a) at least one first combustion chamber in which, in use of the apparatus, residual carbon in particulate hydrocarbonaceous material is combusted.

(b) at least one second reaction chamber disposed in juxtaposed relationship to the first chamber and in which, in use of the apparatus, particulate hydrocarbonaceous material in the form of fresh feed material is contacted in heat exchange relationship with material which previously has been combusted in the first chamber.

(c) at least one first passageway extending between the upper regions of the first and second chambers to permit passage of material between the upper reaches of the chambers, the first passageway incorporating a downwardly facing chute configured to form a densely packed downwardly moving bed of solids therein in use.

(d) at least one second passageway extending between the first and second chambers to permit return passage of material between the chambers, (e) means for admitting a combustion supporting fluid to the first chamber at a rate such that it will induce fluidization of material contained in the first chamber, (f) means for admitting particulate feed material to the second chamber, (g) means for conveying from the apparatus gas vapour products which are generated as a result of kerogen conversion in the second chamber, and (h) means for inducing fluidization in the first chamber in a manner such that the fluidized material is caused to migrate through the chambers by way of the first and second passageways.

This apparatus permits the construction of a relatively compact retort and it provides for efficient movement of heat medium material from a combustion chamber (the first chamber) to a reaction chamber (the second chamber). Kerogen conversion occurs within the second chamber and the spent feed material is then circulated into the first chamber for combustion of residual carbon. The fluidization rate within the first chamber may be adjusted or selected (relative to that in the second chamber) so as to provide for optimum reaction between the combusted material and the feed material. The rate of admission of the feed material is adjusted to meet reaction requirements, and spent material is tapped from the system progressively to permit the addition of fresh feed material.

The fresh feed material preferably is admitted only to the second chamber, although a certain percentage of the feed material may be admitted to the first chamber.

Fluidization of the material in the second chamber may be effected by directing a fluidizing medium into that chamber, or the fluidizing medium may be constituted solely by gas and vapour products which are released by kerogen conversion within the chamber as a result of heat exchange between the circulated combusted material and the feed material. If a fluidizing medium is directed into the second chamber, such medium may comprise recirculated gas and vapour products of the heat exchange reaction and/or a further fluidizing gas.

Circulation of the material through and between the chambers is preferably achieved by providing communication passages between the two chambers at upper and lower levels of the chambers, and by profiling the first chamber in a manner such that the material within such chamber is subjected to an upwardly directed accelerating force.

The combustion supporting gas is preferably preheated by passing it through spent material which is tapped from the first and/or second chambers but which retains a certain amount of heat. Similarly, any fluidizing gas and/or vapour which is directed into the second chamber to aid in fluizidation within that chamber is preferably preheated by passing it through the spent material which is tapped from the first and/or second chambers. Furthermore, the fresh feed material is preferably preheated, prior to its admission to the second chamber, by exposing it to the fluidizing gases and/or product gases and vapours which exit from the first and/or second chambers.

It is highly desirable in apparatus of this type to control or prevent the leakage of gas between the first and second chambers to avoid contamination of the product off-gas by the through gases generated in the first chamber, or alternatively to prevent loss of the product gas through the upper passageway into the first chamber allowing subsequent loss through the flue outlet. The blocking of gas flow from one chamber to the other is achieved by shaping the downwardly facing chute incorporated in the first (upper) passageway to form a densely packed downwardly moving bed of solids within the chute. This densely packed downwardly moving bed of solids forms an effective block to the inadvertent passage of gases between the two chambers. In the preferred form of the invention the downwardly facing chute is configured to form a densely packed downwardly moving bed of solids by the provision of an inclined shelf located at the lower end of the chute and extending from one inside wall of the chute downwardly and transversely across beneath the lower end of the chute. The inclined shelf forms a controlled resistance to the exit of particulate material from the chute causing the material to pack within the chute and form the desired densely packed downwardly moving bed of solids within the chute.

DESCRIPTION OF THE DRAWINGS

The invention will be more fully understood from the following description of a preferred embodiment of an apparatus which is intended for use in the retorting of (i.e., recovery of oil from) crushed oil shale. The description is given with reference to the accompanying drawings wherein.

DESCRIPTION OF THE PREFERRED EMBODIMENT

Figure 1:
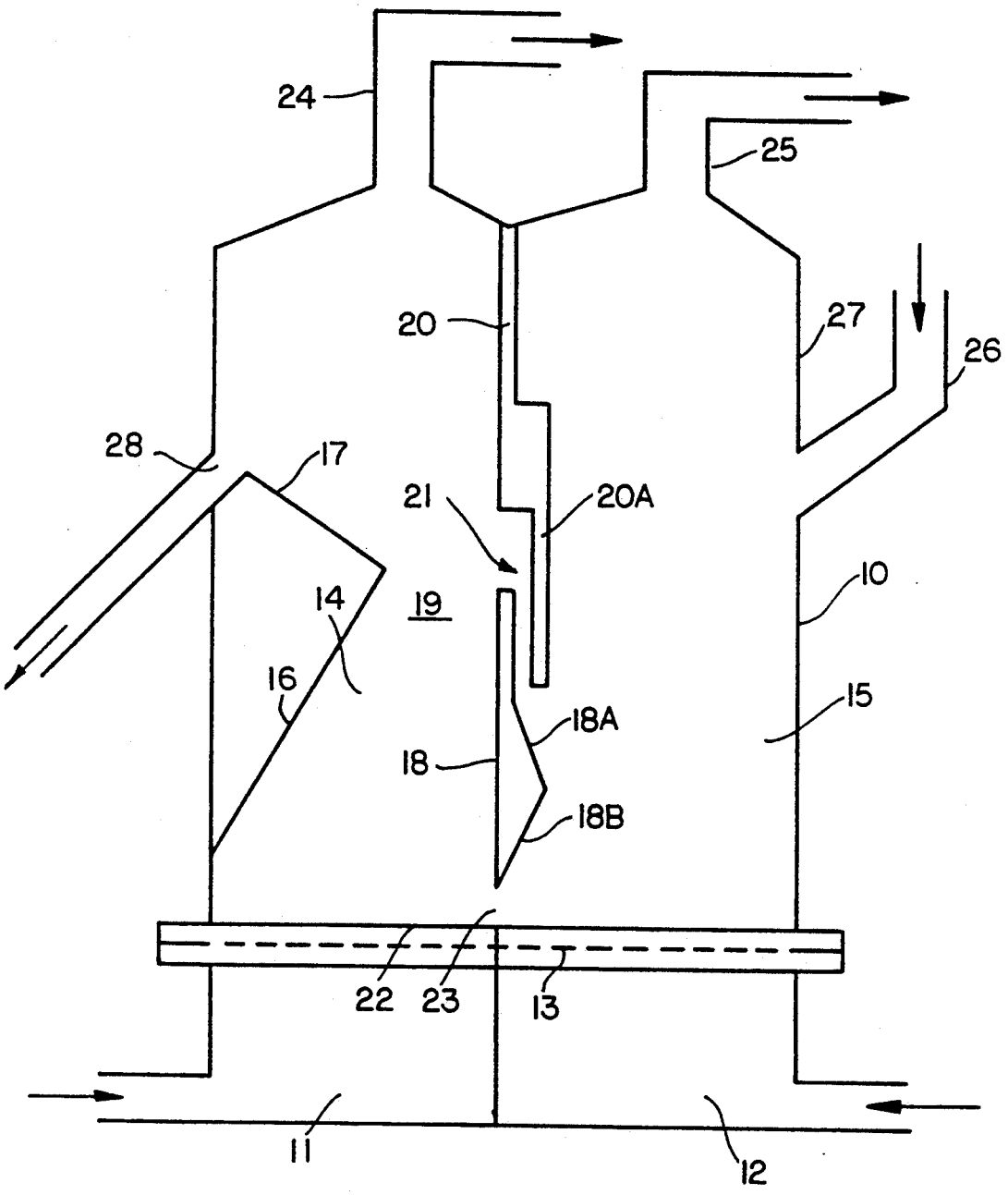
FIG. 1 shows a cross-sectional elevation view of an apparatus which embodies the principles of the invention.

As shown in FIG. 1, the apparatus comprises a housing 10 which is mounted above two partitioned cavities 11 and 12. The housing 10 has a generally rectangular cross-section, as viewed in plan, and a mesh-type grid 13 is interposed between the cavities and the housing.

The housing is divided into first and second chambers 14 and 15, which may be referred to respectively as combustion and reaction chambers, and the first chamber is configured such that its cross-sectional area decreases over approximately two-thirds of the height of the chamber. Thus, the first chamber is defined by one wall 16 which inclines inwardly and upwardly and which intersects a downwardly and inwardly inclined ledge 17, forming a throat 19 in the combustion chamber.

The two chambers 14 and 15 are separated by partition walls, 20 and 18 in which is provided an upper interconnection 21 and a lower interconnection 23. The upper interconnection comprises an opening between the lower part 18 of the partition wall and the upper part 20 and is located in the region of the throat 19. The upper interconnection 21 extends through the wall and then downwardly in a parallel sided portion formed by a baffle 20A. In this manner a passageway is formed extending between the upper reaches of the combustion chamber 14 and the reaction chamber 15.

The dividing wall 18 terminates short of the base 22 of the housing and defines a second passageway 23 which permits communication between the lower reaches of the first and second chambers.

Two exhaust ducts 24 and 25 are located above the first and second chambers 14 and 15, and a feed material inlet 26 extends into a side wall 27 of the housing above the level of the second chamber 15. Additionally, an outlet 28 for spent feed material is located in the combustion chamber, preferably toward the upper edge of the ledge 17.

In operation of the apparatus described thusfar, shale feed in particulate form is loaded into the two chambers and, ignoring start-up conditions, residual carbon in the material in the first chamber 14 is combusted by exposing the (already hot) material to combustion supporting air. The air is delivered to the first chamber 14 by way of the cavity 11 and at a pressure sufficient to fluidize the particles in the first chamber. Fluidization is maintained at a level sufficient to sustain the particles in a fluidized state, but the pressure of the admitted air is not so great as to cause entrainment and exhausting of significant quantities of the particles.

Due to the profiling of the first chamber 14 and the consequential existence of upwardly accelerating fluid forces, the fluidized particles within the first chamber are moved progressively upwardly through the chamber and they then spill over the lip of the wall 18 to enter the second chamber 15 by way of the first passageway 21. On entering the second chamber 15, the particles have a high temperature, resulting from retained heat of combustion of the residual carbon on the particles. Thus, the particles may be referred to as "heat medium shale".

Gaseous products of the combustion process are exhausted through the duct 24 and, being upwardly mobile, tend not to enter the second chamber 15 with the heat medium shale particles.

On entering the second chamber 15, the heat medium shale particles react with fresh feed shale particles, which are admitted to the second chamber 15 by the feed inlet 26, and the consequential heat exchange causes conversion of the kerogen in the feed particles to gas and oil vapour products which are released at all levels throughout the chamber 15. The released gas and vapour products tend to induce fluidization of the heat medium and feed shale particles within the second chamber 15 but, if the fluidizing effect of such products is insufficient to cause a required level of fluidization, a supplementary fluidizing medium may be admitted to the chamber 15 by way of the cavity 12.

The gas and vapour products which are released in the reaction bed within the chamber 15 are exhausted through the duct 25 and, if required, a portion of the exhausted gas and vapour products are circulated back into the second chamber 15, by way of the cavity 12, to act as the fluidizing medium.

The particles within the second chamber 15 are induced to move progressively downwardly through the chamber, as a consequence of the upward movement of the particles in the first chamber 14 and/or as a consequence of the profile of the second chamber, and the particles are thereby induced to pass through the passageway 23 to enter the first chamber 14.

A proportion of the spent material which passes into the first chamber 14 is tapped from that chamber by way of the outlet 28, so that the total volume of material within the two chambers 14 and 15 remains substantially constant with addition of the fresh feed material.

Figure 2:
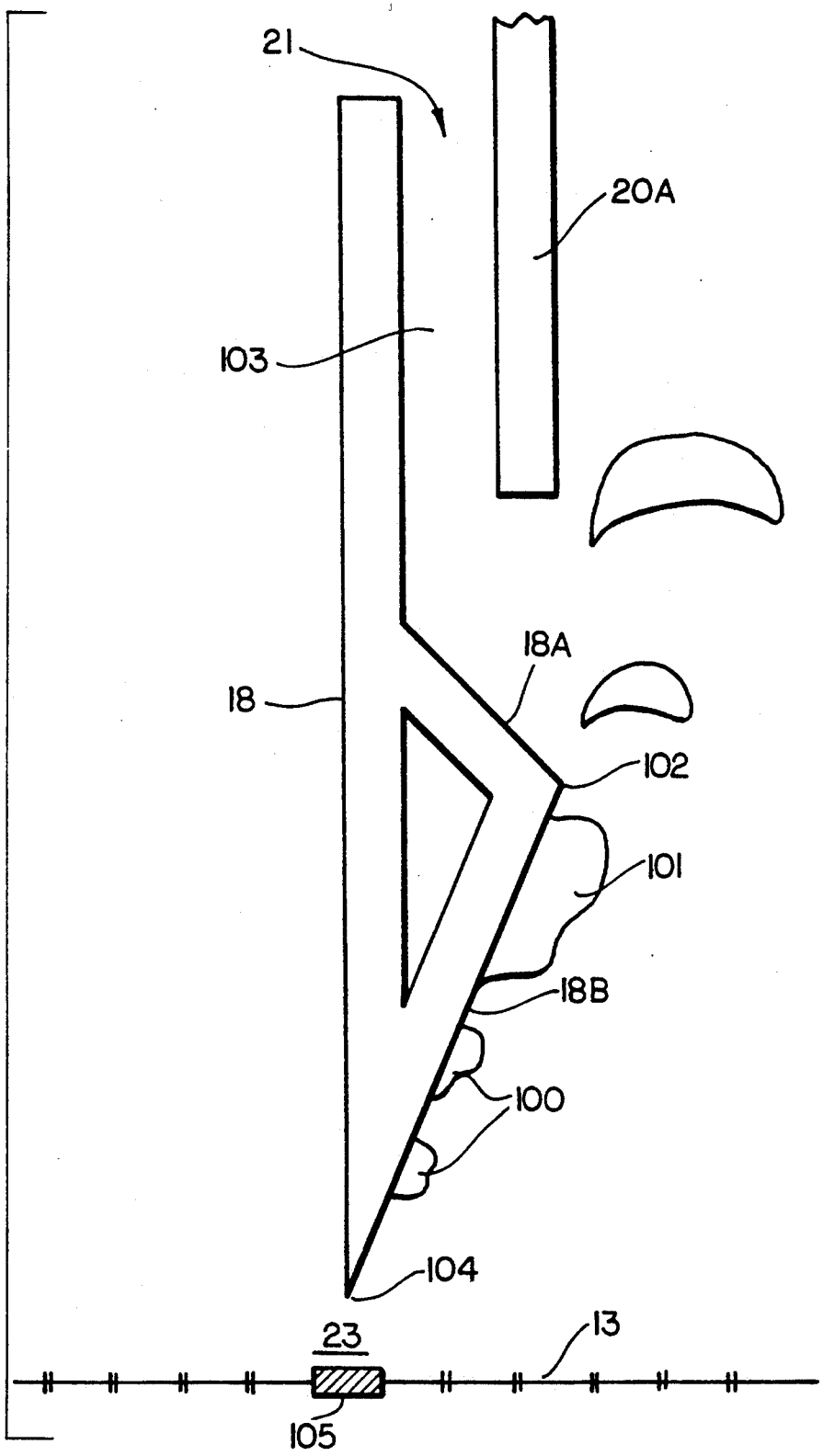
FIG. 2 is an enlarged cross-sectional elevation of the passages between the chambers of the apparatus shown in FIG. 1.

The reaction chamber side of the lower dividing wall 18 is also profiled to a particular configuration as may be most clearly seen in FIG. 2. The lower edge of the wall 18 is brought to a wedge-like configuration immediately above the passageway 23 and is provided with an upwardly inwardly inclined surface 18B protruding into the reaction chamber. This surface is terminated by an upwardly outwardly inclined shelf 18A located below the outlet from the passageway 21. This configuration has the advantage that bubbles 100 from the gas inlet grille 13 or from the pyrolysis reaction in the reaction chamber form on the sloping surface 18B and enlarge as shown at 101 while travelling upwardly along the surface. The bubbles break away from the surface at the intersection point 104 creating a highly aerated zone at the exit from the passageway 21. Solids emerging from the passageway 21 are drawn into the wake of the bubbles in an outward direction giving rise to overall circulation in the fluidized bed. This configuration helps to prevent the solids "short circuiting", i.e. proceeding directly from the outlet from the passageway 21 to the lower interconnection 23.

It is a further feature of the lower wall configuration that the sharp tip 104 allows the use of a small non-aerated zone 105 in the gas inlet grille 13. The small non-aerated zone means that a low clearance can be used between the tip 104 and the grille 13, helping to prevent the undesired passage of gases from one chamber to the other. Should it be found that gas mixing from one chamber to the other is a problem then it is possible to inject an inert gas such as steam into the locality of the passageway 23 (and in some cases even into the upper connecting passage 21) to block the gas transfer.

It is an important feature of the invention that the upper interconnecting passageway 21 is provided through a downwardly facing chute 103 to ensure low gas leakage. It is also desirable that the chute be parallel sided or diverging so that solids will not become jammed and the chute can therefore be narrowed to inhibit gas leakage.

The downwardly facing chute is configured to form a densely packed downwardly moving bed of solids therein in use to inhibit or prevent gas leakage from one chamber to the other. In the preferred form of the invention as shown in FIG. 2 the chute is configured to form the densely packed downwardly moving bed of solids by the provision of inclined shelf 18A located at the lower end of the chute and extending from one inside wall of the chute downwardly and tranversely across beneath the lower end of the chute. This shelf forms a "controlled constriction" at the outlet from the chute causing the solids in the chute to form the desired densely packed downwardly moving bed of solids. The inclined shelf 18A extends transversely outwardly from the partition wall 18 into the second chamber beneath the lower end of the chute, and the partition wall below the inclined shelf incorporates the previously mentioned inclined surface 18B sloping transversely inwardly toward the partition wall downwardly from the lower edge 102 of the inclined shelf.

Figure 3:
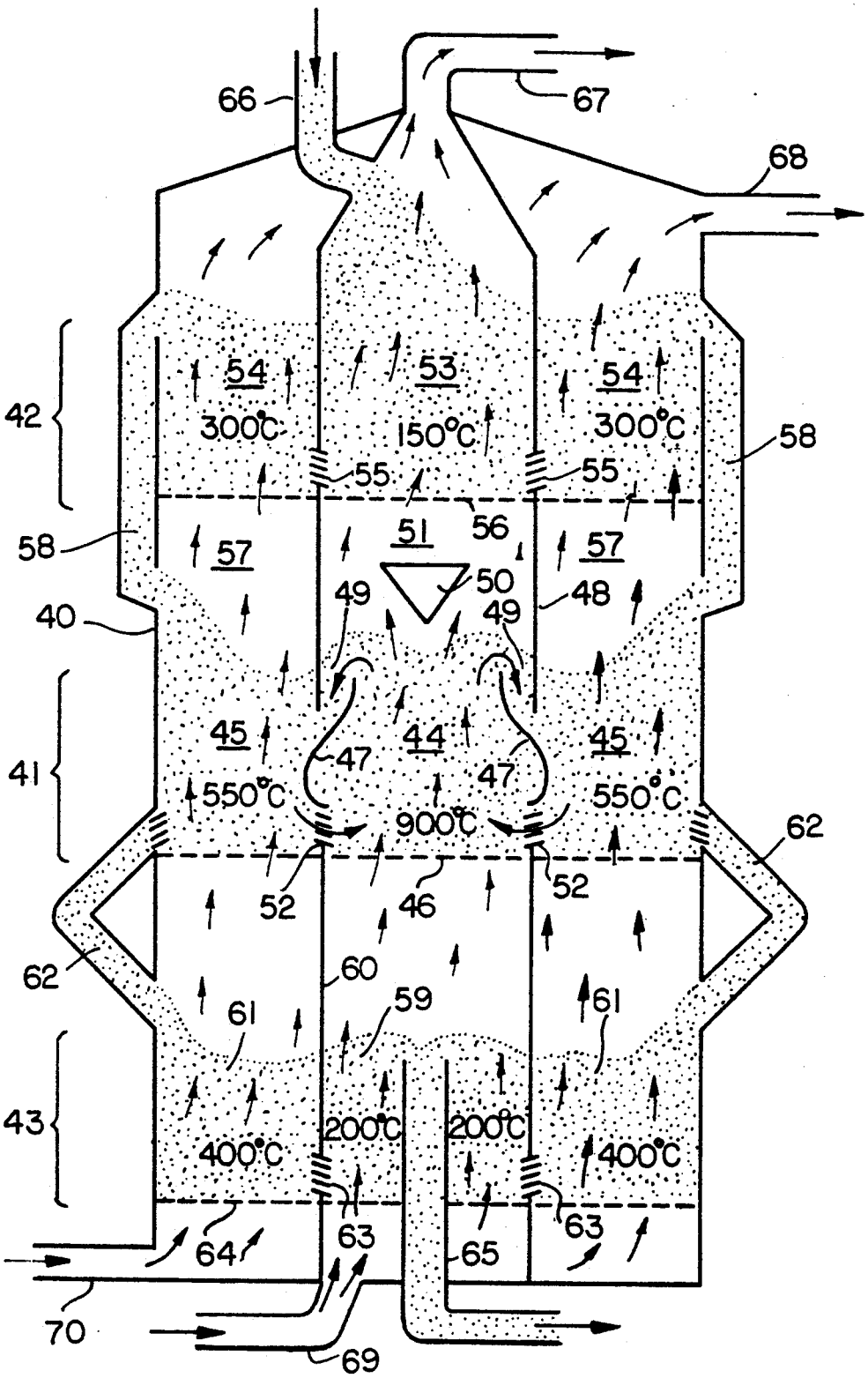
FIG. 3 shows a cross-sectional elevation view of a retorting apparatus which embodies the invention and which also incorporates preheating zones for fluidizing gases and feed material.

Reference is now made to the apparatus which is illustrated in FIG. 3 of the drawings and which embodies, at its mid level, a retorting system which employs the operating principles of the previously described arrangement.

As shown in FIG. 3, the apparatus comprises a generally cylindrical housing 40 which may be considered as having three separate levels. The mid level incorporates a retorting system 41, the upper level incorporates a preheating section 42 for feed shale which is to be delivered to the retorting section in particulate form, and the lower level incorporates a preheating section 43 for fluids which are employed for fluidizing feed and heat medium shale material in the mid level.

The retorting section 41 comprises a generally cylindrical inner first chamber 44 in which residual carbon in spent feed shale is combusted and a surrounding annular second chamber 45 in which the combusted shale particles are reacted with fresh feed shale particles. The two chambers 44 and 45 are located above a mesh-type base 46 through which fluidizing gases and/or vapours may be passed to enter the respective chambers.

The first chamber 44 is defined by a surrounding wall 47 which is shaped in a manner such that fluid passing upwardly through the chamber increases in velocity when passing through the upper reaches of the chamber. Thus, fluidized particles within the chamber 44 are subjected to an upwardly accelerating force and are caused to migrate upwardly through the chamber.

The wall 47 also forms an inner wall of the (annular) second chamber 45 and its shaping has the effect of imparting a downwardly directed accelerating force to particles which are at any given time located in the second chamber.

A cylindrical wall 48 surrounds the upper end of the wall 47, and the wall 48 performs a dual function. It channels gaseous products which are released in the first chamber 44 in an upward direction and it defines (with the wall 47) a first annular passageway 49. A wedge-shaped deflector 50 is located in the gas column 51 which is defined by the wall 48, and the deflector serves to divert upwardly mobile shale particles into the second chamber 45 by way of the passageway 49.

A second passageway 52 interconnects the first and second chambers 44 and 45 in their lower reaches.

The cylindrical wall 48 extends upwardly through and above the upper level 42 of the apparatus and, in so doing, it divides the preheating section into a cylindrical inner chamber 53 and an annular outer chamber 54. Transfer passages 55 extend through the wall 48 above the level of a mesh-type base 56 of the chambers 53 and 54.

Fresh particulate feed shale is fed into the inner chamber 53 where it is dried and preheated by gases which rise through the column 48, and the material is caused to pass into the annular chamber 54 where it is subjected to further preheating by product vapours and gases which flow upwardly through an annular passage 57. The material within the chambers 53 and 54 is fluidized by the upflowing gases and vapours, and the fluidization in the annular chamber 54 is maintained at a level sufficient to cause the material within such chamber to enter downwardly extending feed channels 58.

The lower level 43 of the apparatus is constructed in a manner similar to the upper level 42 and it constitutes a heating zone for fluidizing medium which is directed into the retorting system. Thus, the lower level 43 incorporates a central chamber 59 which is defined by a cylindrical wall 60, and an annular outer chamber 61. Spent shale material is directed into the outer chamber 61 by way of feed channel 62, and the material passes into the inner chamber 59 by way of passages 63 in the wall 60.

The chambers 59 and 61 have a common base 64 of mesh-type construction, and a central discharge conduit 65 projects through the base 64.

In operation of the apparatus which is shown in FIG. 3, fresh feed shale (which may be wet) is delivered to the chamber 53 by way of an inlet 66 and the shale particles are dried by hot gases which pass through the chamber 53 en route to a flue outlet 67. The feed shale then migrates into the surrounding chamber 54 where it is exposed to further heating by product gases and vapours which rise through the chamber in passing to a product discharge line 68.

Thereafter, the feed shale is directed into the chamber 45 where it mixes in a fluidized reaction bed with previously combusted (heat medium) shale particles. When in the fluidized reaction bed within the chamber 45, heat exchange between the heat medium shale and the fresh feed shale results in kerogen conversion in the feed shale and the released gas and vapour products pass upwardly through the passage 57 to heat the feedstock in the chamber 54 before proceeding to the product discharge line 68.

As previously described, the shale particles, including the fresh feed and heat medium shale particles, in the reaction bed migrate in a downward direction and pass through the passageway 52. At the time of passing through the passageway 52 a major portion of the kerogen content of the feed shale has been converted to product gas and vapour but residual carbon remains in the particles. This carbon is combusted in the presence of air in the chamber 44.

The combustion supporting air is admitted by way of an air inlet 69, and the gaseous products of combustion are directed upwardly through the chamber 53 before being exhausted as flue gases.

The combustion supporting air acts as a fluidizing medium during its passage through the combustion chamber 44 and, as a result of the wall profile 47, the shale particles are carried upwardly through the chamber 44 to enter the passageway 49. Thus, the feed and heat medium shale particles are circulated through the two chambers 44 and 45, and a percentage of the circulated material is tapped from the chamber 45 for transfer to the lower annular chamber 61.

A portion of the product gas and vapour which is released in the reaction bed in the chamber 45 is diverted from the product line 68 and recycled back through the system. The recycled gas and vapour is admitted to the system by way of an inlet 70 and it is heated as it passes through the chamber 61. Thereafter, it acts as a fluidizing medium for the shale particles in chambers 45 and 54.

The spent (but still hot) shale particles which are tapped into the chamber 61 then pass into the chamber 59 and serve to heat the combustion supporting air which is employed to fluidize the material in the combustion chamber 44. Whilst resident in the chamber 59, upward mobility is imparted to the particles by the inflowing combustion supporting air and the particles are induced to flow into the discharge conduit 65.

Temperatures which might typically apply to the material in the various portions of the apparatus which has been described above are shown in FIG. 3 of the drawings.

Figure 4:
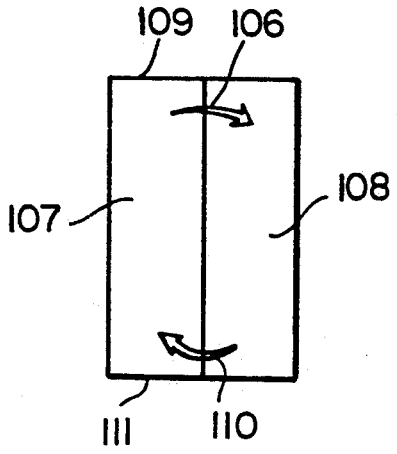
FIG. 4 is a schematic plan view of an alternative layout of the two chambers.

Although the invention has been described thusfar with reference to transfer between the combustion and reaction chambers as taking place through an upper interconnection from the combustion chamber to the reaction chamber and a lower interconnection in the opposite direction, it is also possible to achieve circulation by transfer through two upper interconnections (i.e. by two "overflow" transfers rather than by an "overflow" and "underflow" combination) in which at one end of a rectangular bed solids are thrown from left to right and at the other end solids are thrown from right to left as shown diagrammatically in plan view in FIG. 4. In this situation solids are overthrown at 106 from the combustion chamber 107 to the reaction chamber 108 adjacent one end 109 and are returned, also by overflow 110 adjacent the other end 111. Where multiple "overflow" transfer passageways are utilized, each passageway incorporates a downwardly facing chute configured to form a densely packed downwardly moving bed of solids therein in use in a similar manner to that described for passageway 21 previously described with reference to FIGS. 1 and 2.

Simplified theory of fluidized beds often assumes that the beds are "perfectly mixed". Hence a small cluster of particles entering the bed will immediately be dispersed. This is one extreme theoretical model. Another is so-called "plug flow" in which the cluster of solids maintains its identity as it flows through the bed in the shortest possible journey. Sometimes "perfect mixing" is desirable, sometimes plug flow, and sometimes a hybrid. In any event is is always desirable to be able to "dial in" whatever level of mixing is required.

In the first version of the invention, solids leave one chamber via the top of the bed ("overflow") and reenter at the bottom ("underflow"), and both chambers approximate perfect mixing.

Figure 5:
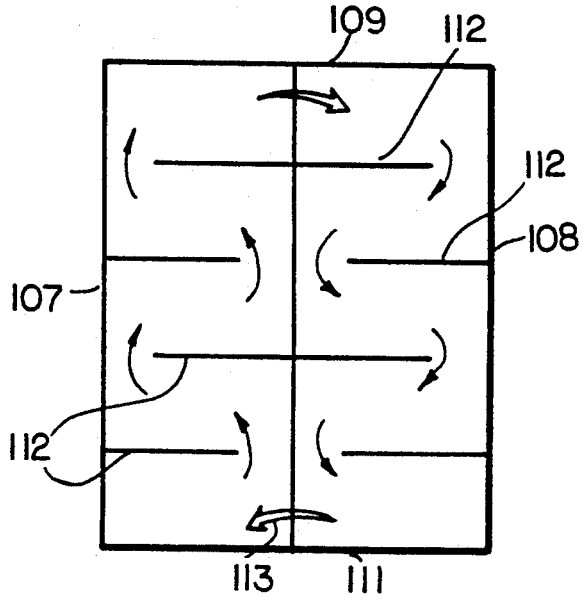
FIG. 5 is a schematic plan view of an alternative configuration providing for plug flow.

The "double overflow" system as shown basically in FIG. 4 opens up the possibility of achieving something approaching plug flow in the system using a series of baffles as shown in FIG. 5. In this situation the configuration of the chambers is basically as shown in FIG. 4 with the addition of staggered baffles 112. This forms a tortuous path in each chamber inducing plug flow through the baffles as shown by the single arrows in FIG.5. The more baffles that are provided the closer is the approximation to plug flow. Although the configuration shown in FIG. 5 incorporates "double overflow" it will be appreciated that the return flow 113 could equally be an underflow return of the type shown in FIGS. 1 to 3.

Figure 6:
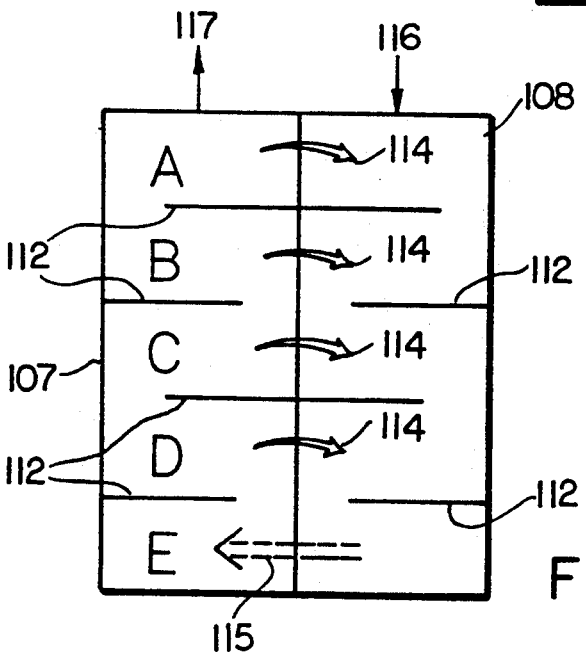
FIG. 6 is a schematic plan view of a still further alternative configuration.

A further configuration using "multiple overflow" between baffle chambers is shown diagrammatically in FIG. 6 having a similar configuration to that of FIG. 5 but incorporating multiple overflow interconnections 114. The return flow could be by way of "underflow" 115. The raw feed shale is fed into the reaction chamber 108 at 116 and the spent shale is withdrawn from the combustion chamber 107 at 117. The baffles divide the system into five chambers A, B, C, D and E. In chambers A, B, C, and D we have overflow left to right as shown in FIG. 6 and in chamber E we have return underflow right to left. The individual chambers can be designed to achieve different circulation rates in each chamber; the baffles ensure that the solids are no longer perfectly mixed but approach plug flow.

In practice this means that any temperature profile can be achieved in the retort to optimize the yield. Thus chamber A might be run at a relatively low temperature to protect sensitive species; and the temperatures could be increased in the chambers B, C, D to drive off all the product. Thus we have the high yields associated with high temperature, and the benefits of a gradual and controlled temperature increase.

There is an additional advantage that the approach to plug flow achieves; The shale entering the system would not be able to pass quickly through the retort (no by-passing) and this means the losses associated with by-passing would be reduced.

Similarly in the combustion chamber, the losses of carbon fuel on the spent shale would be reduced because spent shale could not by-pass the system.

Hence this system would seem to offer prospects of very high yields and very high recovery of the energy values on the spent shale.

What is claim is:

1. Apparatus for the recovery of oil from solid hydrocarbonaceous material in particulate form comprising:

(a) at least one first combustion chamber in which, in use of the apparatus, residual carbon in particulate hydrocarbonaceous material is combusted;

(b) at least one second reaction chamber disposed alongside the first chamber and in which, in use of the apparatus, particulate hydrocarbonaceous material in the form of fresh feed material is contacted in heat exchange relationship with material which previously has been combusted in the first chamber, the first and second chambers being separated by a partition wall;

(c) an upper passageway extending through the partition wall to permit passage of material between the chambers, the upper passageway incorporating a downwardly facing chute having an upper and a lower end for movement of material from the first chamber to the second chamber by the weight of the material;

(d) an inclined shelf located immediately below the lower end of the chute and extending from one side of the chute downwardly and transversely across beneath the lower end of the chute, the size and inclination of the shelf for forming a densely packed downwardly moving bed of solids in the chute in use, wherein the inclined shelf extends transversely outwardly from an upper edge adjoining the partition wall to a lower edge protruding into the second chamber beneath the lower end of the chute, and wherein an inclined surface is provided sloping transversely inwardly toward the partition wall downwardly form the lower edge of the inclined shelf, the said inclined surface promoting the upward movement of particulate material and entrainment of gas bubbles causing particulate material entering the second chamber through the chute to be entrained in an upward movement for circulation and mixing within the second chamber;

(e) a lower passageway extending through the partition wall between the first and second chambers below the upper passageway to permit return passage of material between the chambers;

(f) means for admitting a combustion supporting fluid to the first chamber at a rate for inducing fluidization of material contained in the first chamber and movement of that material into the upper passageway;

(g) means for admitting particulate feed material to the second chamber; and (h) means for removing from the apparatus gas vapor products which are generated as a result of kerogen conversion in the second chamber.

* * * * *